US005418998A

United States Patent [19]

Smarra

[11] Patent Number: 5,418,998

[45] Date of Patent: May 30, 1995

[54] HAND HELD ICE SCRAPER

[76] Inventor: Dennis M. Smarra, 425 Seymour Dr., West Newton, Pa. 15089

[21] Appl. No.: 5,226

[22] Filed: Jan. 15, 1993

[51] Int. Cl.[6] ..... A47L 1/06

[52] U.S. Cl. ..... 15/105; 15/236.02; 15/236.05; 15/245; 428/217

[58] Field of Search ..... 15/235.4, 236.01, 236.02, 15/236.05, 245, 245.1, 105; 428/217, 412

[56] References Cited

U.S. PATENT DOCUMENTS

| | | | |
|---|---|---|---|
| 2,242,992 | 5/1941 | Devor | 30/169 |
| 2,277,528 | 3/1942 | Osborn | 15/236.02 |
| 2,856,621 | 10/1958 | Racicot | 15/105 |
| 3,408,677 | 11/1968 | Yates . | |
| 3,686,703 | 8/1972 | Ray | 15/235.4 |
| 3,871,049 | 3/1975 | Workman | 15/250.04 |
| 4,040,140 | 8/1977 | Hopkins . | |
| 4,075,730 | 2/1978 | Siemund | 15/245 |
| 4,316,302 | 2/1982 | Clark | 15/245.1 |
| 4,495,668 | 1/1985 | Adams | 15/236.02 |
| 4,495,670 | 1/1985 | Baker . | |
| 4,654,919 | 4/1987 | Liberman | 15/245.1 |
| 4,847,940 | 7/1989 | Bradbury | 15/250.36 |
| 4,946,360 | 8/1990 | Brown | 15/245.1 |
| 5,099,540 | 3/1992 | Paschetto | 15/236.02 |
| 5,221,828 | 6/1993 | Basheer et al. | 15/250.05 |

OTHER PUBLICATIONS

Modern Plastics, Jan. 1952, p. 104.

*Primary Examiner*—Mark Spisich

*Attorney, Agent, or Firm*—Lawrence R. Burns

[57] ABSTRACT

A windshield wiper scraping device is disclosed with multiple scraping or working surfaces for cleaning ice or other material from the windshield of a vehicle. In the preferred embodiment the scraping device has a composite body comprising two polygonally shaped plate bodies that have planar top and bottom surfaces with a side wall forming the perimeter of the body and joining the top and bottom surfaces. Working edges are formed at the juncture of the side wall with both the told and bottom surfaces. The body is preferably formed of a first plate-like body of rubber and a second plate-like body of plastic. The two bodies are releasably held together by co-operating elements of threaded means. The plastic material is preferably a form of the "LEXAN" material so that it forms a hard semi-rigid working edges on the top while the rubber material is formed of a rubber with the hardness in the range of 70–90 durometers. The resilient edge formed by the rubber has advantages in certain weather over the hard semi-rigid edge formed by the plastic. Preferably the body is formed by two plate-like substances, one of rubber and the other of plastic that can be joined together by chemical or fastener means. The device is sized to be held in the hand and may be pushed or pulled over the windshield of a vehicle. The polygonal shape of the body is preferably either square or octagonal so as to provide multiply working edges during the life of the device.

8 Claims, 3 Drawing Sheets

HAND HELD ICE SCRAPER

FIELD OF THE INVENTION

This invention has to do with a vehicle scraping and squeegee devices for cleaning the windshield of a motor vehicle. More specifically, this invention has to do with a hand held vehicle windshield cleaning device that can act as either a scraper or squeegee depending on the conditions encountered by the user.

BACKGROUND OF THE INVENTION

As any vehicle owner can attest the importance of a clean windshield throughout the year is important to the safety and operation of the vehicle. In the summer months the vehicle owner usually encounters only water and other dirt like material which can be fairly easily cleaned from the windshield by turning on the wipers on the vehicle. However, even in this case, the wipers only clean a specific area of the windshield and leave the peripheral areas outside of the reach of the windshield wipers in an unclean condition. During the winter months the cleaning of the windshield becomes even more difficult due to the formation of ice because of the temperature range usually anywhere from forty degrees Fahrenheit down to zero degrees Fahrenheit. As the temperature drops through the freezing point of water, at thirty two degrees Fahrenheit, the ice on the windshield acts differently for each temperature which it encounters. particularly, just around the freezing point the water and ice is in the transition phase where it may be a slush material that can be removed by a pliable material which may be pushed or pulled across the windshield. As the temperature drops from thirty two degrees Fahrenheit the ice becomes harder and less slushy and forms a more secure attachment to the windshield thereby making an effort to remove it more than a squeegee type action but rather a scraping or chipping action and that is necessary to separate the ice from the windshield. In some cases the ice may form a liquid boundary between the windshield and the ice itself such that pushing on the ice can cause it to break free from the windshield and slide over the liquid boundary between the ice and the windshield. In other cases as the temperature drops even further, the ice must be scraped from the windshield. Other conditions such as turning on ones defroster while one attempts to clean the windshield can help in loosening the ice formation from the windshield by pushing or pulling action. Because conditions can vary, it is important to the operator of a vehicle to have a cleaning device that may be operable through all the temperature extremes and conditions of ice or other dirt on the windshield that one may encounter.

Previous attempts to furnish tools have produced a long handled devices that do one or the other, either provide a chipping and scraping action by pushing the edge of the tool across the surface of the ice or a squeegee action that may clean the windshield by both pushing and pulling across the wet surface of the windshield. Some devices have provided a simple pologonally shaped body that is of a hard and rigid plastic material that can be used specifically to scrape and chip the ice on the windshield by pushing the cutting edge away from the body of the vehicle operator. It is important, of course, that any material that is used to clean the windshield not be of such a hardness that the windshield will be damaged during the cleaning operation.

OBJECTS OF THE PRESENT INVENTION

It is an object of the present invention to provide a handheld scraping device that may be utilized throughout both the winter and summer months.

It is an object of the present invention to provide a cleaning device for a windshield that has multiple working edges to improve the life of the cleaning device.

It is an object of the present invention to provide a scraping device that may ultimately be used to chip and scrape ice from a windshield and to squeegee the windshield to clear any liquid or other debris that may be left thereon.

It is an object of the present invention to provide a composite body of rubber and plastic having scraping or working edges formed of both plastic and rubber material for use in cleaning the vehicle windshield.

It is still a further object of the present invention to provide a windshield cleaning device that has multiple working edges for cleaning ice from a windshield and multiple working edges for squeegeeing a vehicle windshield.

It is still a further object of the present invention to provide a vehicle windshield cleaning device for cleaning ice from the windshield that may be effectively used by pushing or pulling the working edge across the ice surface and the windshield.

It is still a further object of the present invention to provide a windshield ice scraping device whose life may be prolonged by providing a working edge on the tool that will not break or chip during the removal of ice from the windshield.

It is still a further object of the present invention to provide a convenient hand held and easily storable windshield cleaning device that may be used in both winter and summer by the vehicle operator.

It is still a further object of the present invention to provide a windshield wiper cleaning device with two distinct type working edges for cleaning the windshield of a vehicle wherein the selection of one of the two working edges only requires the manipulation of the tool to an inverted position.

It is still a further object of the present invention to provide a windshield wiper cleaning device with a working edge of the tool may be easily leveraged into advantageous working position by the hand of the person cleaning the windshield.

It is a still further object of the present invention to provide two plate-like bodies that may be flipped over to provide new scraping edges.

BRIEF SUMMARY OF THE INVENTION

According to the present invention there is provided a windshield wiper and scraping device which comprises a polygonally shaped plate body having opposed top and bottom surfaces. Side walls form the perimeter of the body and join the top and bottom surfaces forming working or scraping edges at the juncture of the side walls with the top and bottom surfaces.

The body is formed of a composite material of rubber and plastic with the plastic material forming one of either the top or bottom surfaces and the rubber material forming the other of the top and bottom surfaces. The body is sized so as to be held conveniently in the hand when one of the working edges is pushed or pulled over the windshield of a vehicle.

The plastic material is preferably formed of a plexiglass, acrlic, or synthetic resin material, such as "LEXAN" so as to be in more hard and semi-rigid condition than said rubber material and yet not scratch the glass which is being cleaned. The rubber material is preferably formed to be in a more resilient and pliable condition than the plastic material and most preferably is formed to be in the hardness range of seventy to ninety durometers.

The body preferably comprises two separate plate-like bodies located in an abutting relationship to one another and held together by threaded fasteners. In another preferred mode the two plate-like bodies are held together by an epoxy resin cement rather than threaded screw fasteners.

The polygonal body in one of the preferred forms is a square and in another preferred form the polygon is an octagon.

Another aspect of the invention is that the two plate-like bodies that are joined together by the threaded fastener means may be taken apart and reversed after a long period of use or after wear becomes noticeable on the working edges. In this way the scraper according to the present invention has at least 16 possible working edges for each device when the device is configured in the shape of a square.

It is also a further advantage of the present invention that advertising material may be placed between the plate-like bodies so that it can be seen through the plastic material.

It is to be noted that the use of the term "LEXAN" herein is to designate a "LEXAN" like material, it being understood that "LEXAN" is a polycarbonate material and that "LEXAN" is a trademark of DuPont.

DETAILED DESCRIPTION OF THE DRAWINGS

Figure 1:
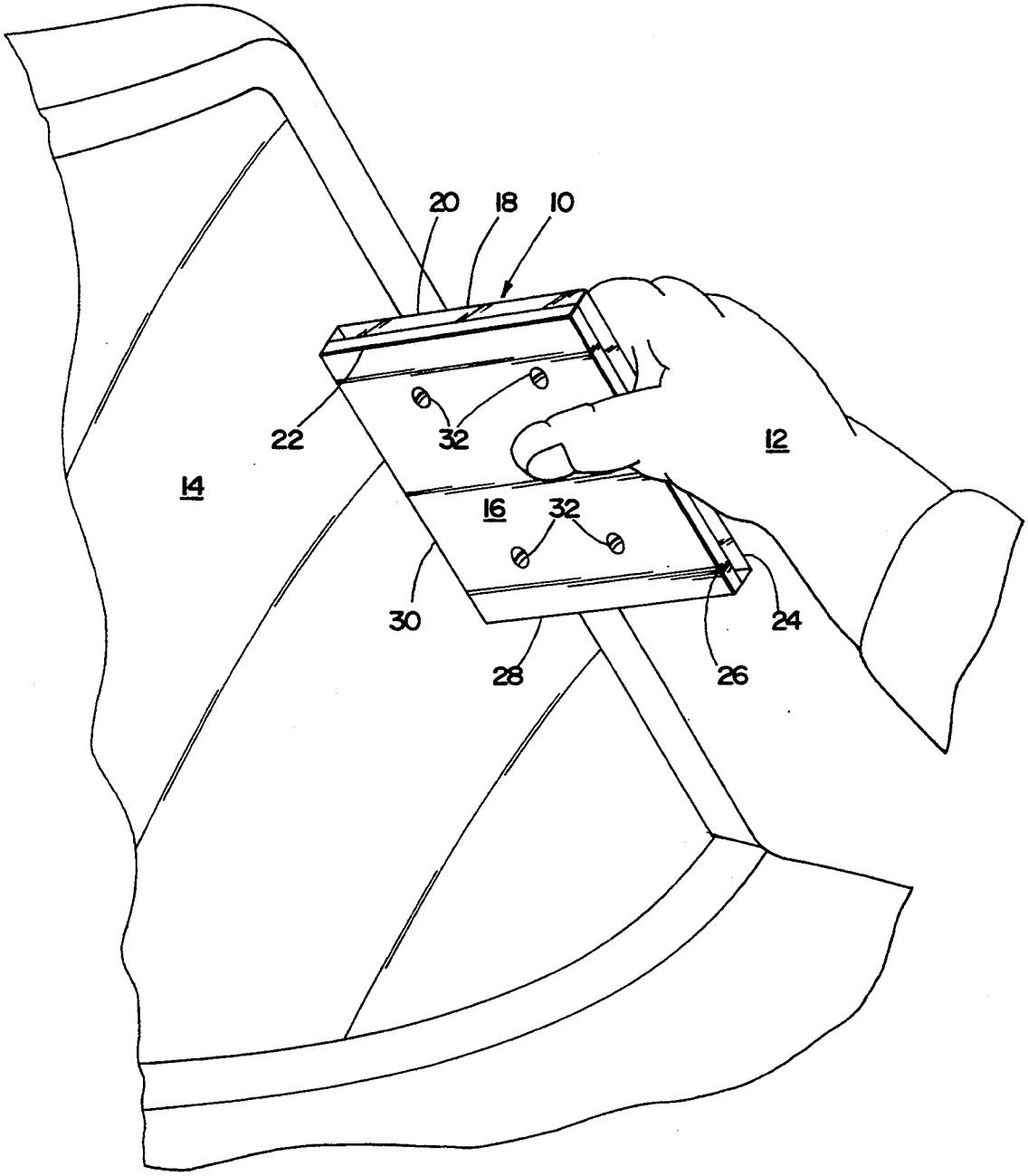
FIG. 1 is a perspective view of an ice scraper according to the present invention.

What is shown in FIG. 1 is a hand held ice scraper 10 according to the present invention that is sized so as to be able to the held by a persons' hand 12 while it is applied to a windshield 14 of a motor vehicle. The scraper 10 has one side 16 that may be made of a rubber or plastic material and an opposing side 18 that may be made of the other of either the rubber or plastic material. The hand held scraper is shown having working or scraping edges 20, 22, 24, 26, 28 & 30. Fasteners 32 are shown holding the rubber material 16 together with the plastic material 18. The hand held ice scraper is formed of a polygonally shaped plate body which is preferably either octagonal shaped or square shaped and sized so as to be able to allow a person to hold the device in his hand while one of the working edges is applied against the windshield of the motor vehicle.

Figure 3:
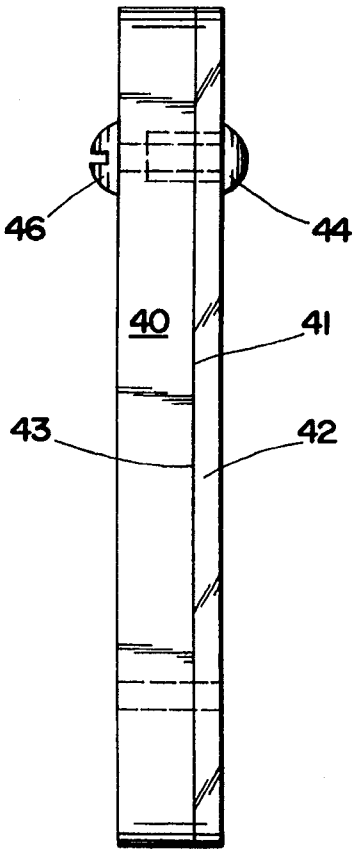
FIG. 3 is a side view of the ice scraper of FIG. 2.
Figure 2:
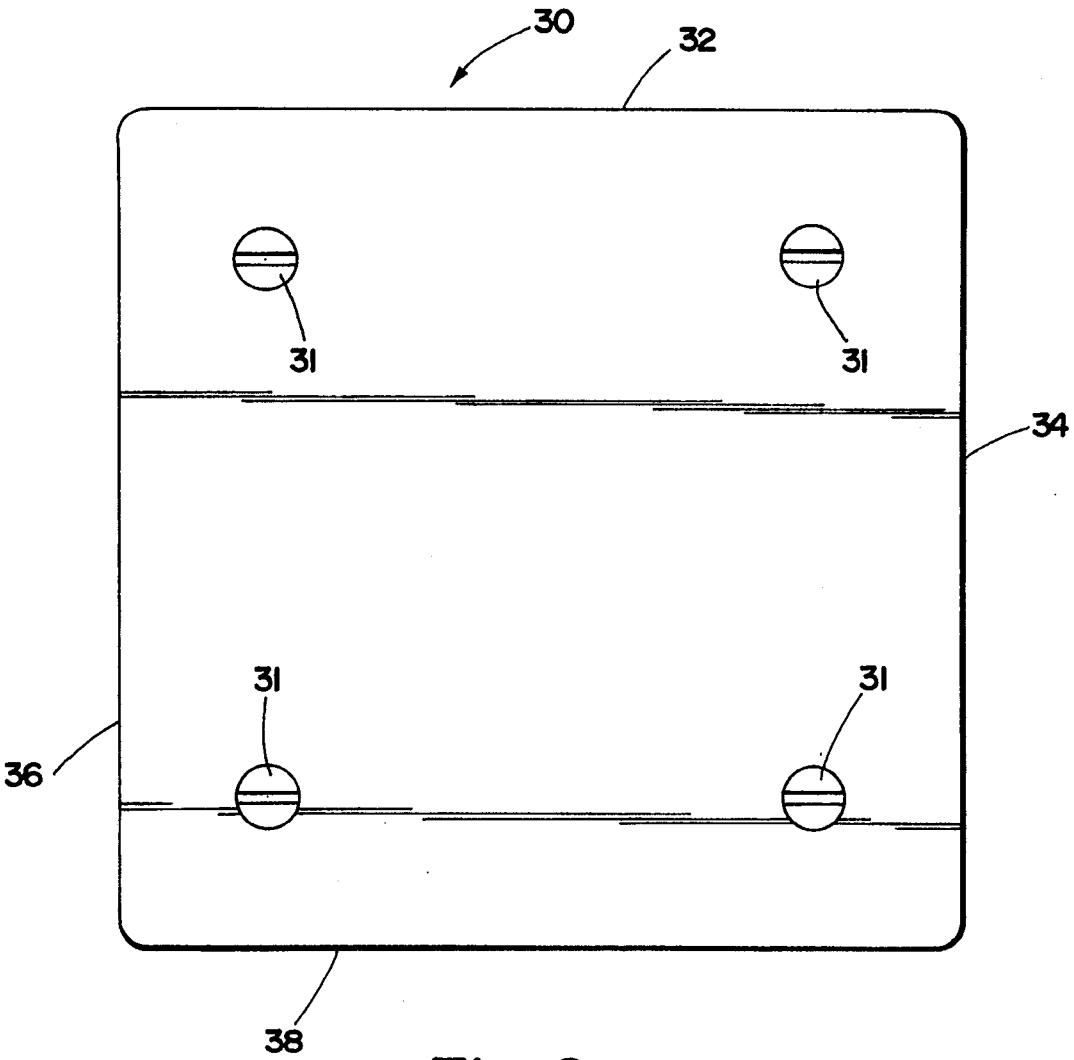
FIG. 2 is a plan view of an ice scraper according to the present invention.

Shown in FIG. 2 is a hand held ice scraper 30 according to the present invention but in this particular case there are four cutting edges shown in 32, 34, 36, and 38. Additional scraping edges or working edges are to be found opposite these enumerated working edges on the opposite side of the device not shown in the drawing figure. The square configuration found in the drawing figure preferably measures four to five inches in length along each edge with the most preferred dimension being four and one half inches from side to side of the square. Fasteners 31 are shown typically holding the composite body of plastic and rubber together. Shown more specifically in FIG. 3 is the hand held ice scraper 30 shown as the composite body of a hard rubber substance 40 joined to a hard plastic material 42. The hard rubber material 40 is preferably formed of a rubber material having a hardness in range of 70–90 durometers and being approximately one quarter to three eighth's of an inch in thickness, while the plate-like body 42 is preferably formed of a synthetic resin material, an acrylic or a "LEXAN" material and is approximately one eighth of an inch in thickness. The composite body formed of plates 40 & 42 are held together by fastener means 44 & 46 which are preferably cooperating elements of threaded means that may be unscrewed to release the bodies for either replacement or repair during the life time of the device.

Figure 4:
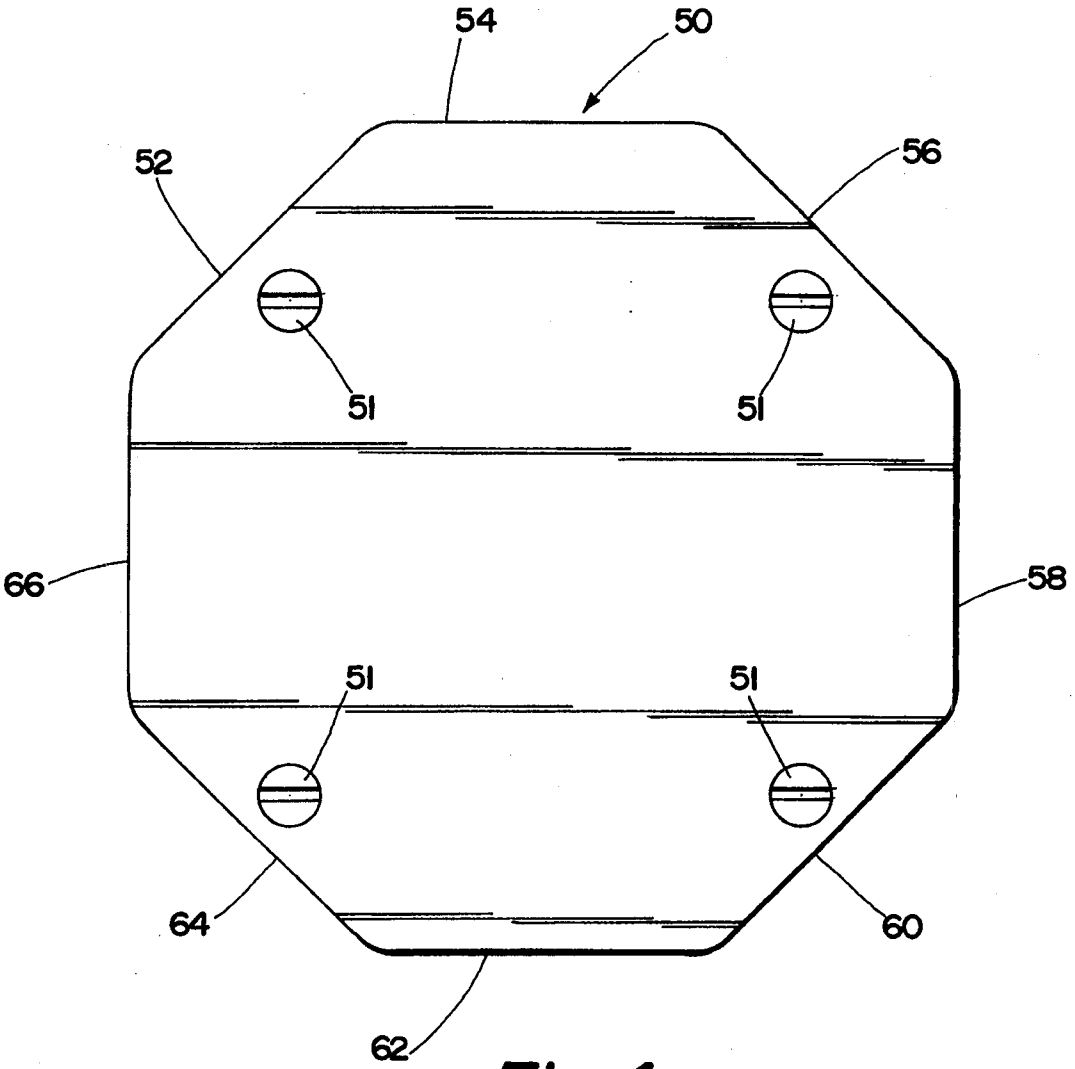
FIG. 4 is an plan view of another ice scraper according to the present invention.

Shown in FIG. 4 is another hand held tool 50 similar to that of 10, only this time being of an octagonal nature having working edges shown 52, 54, 56, 58, 60, 62, 64, & 66. Again the fasteners such as 51 are shown typically holding the composite body together.

Figure 5:
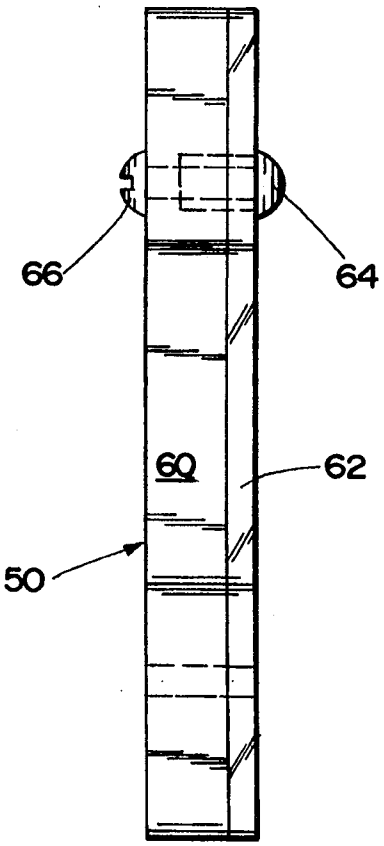
FIG. 5 is a side view of the ice scraper of FIG. 4.

Shown more specifically in FIG. 5 is the body 50 comprised of a hard rubber material 60 and a plastic material 62. The hard rubber material 60 is preferably a rubber material having a hardness in the range of 70–90 durometer and the plastic material is formed of a "LEXAN" material or other polyacrilic, synthetic resin or hard semi-rigid type plastic material that has been found widely useful in the chipping and scraping of ice from windshields. The fasteners 64 and 66 are shown again holding the hard rubber material 60 and the plastic material 62 in an abuttingly adjoined relationship of one to another.

Looking at FIG. 3 it can be seen that releasing the fasteners 46 and 44 will allow the plates to be reversed so that the additional cutting edges formed at the junctures of the peripheral wall with the top and bottom surfaces of each plate-like body can be used. For instance the body 40 in FIG. 3 has working edges 41 on 40 abutting working edges 43 on 42. As is typical on all four sides the working edges 41 and 43 may be turned outward by separating the bodies 40 and 42 and reversing them and then re-fastening them together by threaded fasteners 46 and 44 which are shown typically in Figure three but have at least four such connectors as is shown at 31 in FIG. 2.

Rather than use the fasteners 64 and 66 it may be more inexpensive and expedient to bond the hard rubber material 60 to the plastic material 62 in a chemical fashion such as by using an epoxy type cement adhesive to chemically bond one to the other.

Whereas a particular embodiment of the invention has been described above for purposes of illustration, it will be evident to those skilled in the art that numerous variations of the details may be made without departing from the scope of the invention as defined in the appended claims.

I claim:

1. A windshield wiper and scraping device which comprises:

a. two congruent and polygonally shaped plate bodies with each body having opposed top and bottom surfaces with side walls forming the perimeter of said body and joining said top and bottom surfaces;

b. working edges formed on the bodies by the juncture of said side walls with said top and bottom walls to provide twice the number of cutting edges as said sides of said body;

c. one of said bodies formed of a rubber material and the other of said bodies formed of a plastic material;

d. said plate bodies having a plurality of aligned apertures through which releasable fastener means may pass and be connected;

e. releasable fastener means holding one of the top and bottom surfaces of one body in a congruent and abutting relationship with one of the top and bottom surfaces of the other body;

f. both of said bodies capable of being reversed top to bottom while said releasable fastener means is released to provide new cutting edges;

g. said bodies sized so as to be held in the hand when one of said working edges is pushed or pulled over the windshield of a vehicle.

2. The windshield wiper and scraping device according to claim 1 in which said plastic material is formed to a more hard and rigid condition than said rubber material.

3. The windshield wiper and scraping device according to claim 1 in which said rubber material is formed to a more resilient and pliable condition than said plastic material.

4. The windshield wiper and scraping device according to claim 1 in which said plastic material is formed of a polycarbonate material.

5. The windshield wiper and scraping device according to claim 1 in which each polygonal body forms a square.

6. The windshield wiper and scraping device according to claim 1 in which each body forms an octagon.

7. The windshield wiper and scraping device according to claim 1 in which said plastic material comprises a transparent material.

8. The windshield wiper and scraping device according to claim 1 in which said polygonal shape is a square.

* * * * *